US009318084B2

(12) United States Patent
Lafrenz et al.

(10) Patent No.: US 9,318,084 B2
(45) Date of Patent: Apr. 19, 2016

(54) SUPPORT SYSTEM AND METHOD FOR A PERCUSSION INSTRUMENT

(71) Applicant: PEARL CORPORATION, Nashville, TN (US)

(72) Inventors: Shawn D. Lafrenz, Murfreesboro, TN (US); Matthew G. Jordan, Nashville, TN (US)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 14/538,394

(22) Filed: Nov. 11, 2014

(65) Prior Publication Data

US 2015/0128787 A1 May 14, 2015

Related U.S. Application Data

(60) Provisional application No. 61/903,171, filed on Nov. 12, 2013.

(51) Int. Cl.
*G10G 5/00* (2006.01)
*G10D 13/02* (2006.01)

(52) U.S. Cl.
CPC ..... *G10D 13/026* (2013.01); *G10D 13/02* (2013.01); *G10G 5/00* (2013.01)

(58) Field of Classification Search
CPC ..... G10G 5/00; G10D 13/02
USPC ..... 84/421
See application file for complete search history.

(56) References Cited

U.S. PATENT DOCUMENTS 342,062 A * 5/1886 Bemis ..... G10D 13/026 248/163.1
994,289 A * 6/1911 Unger, Jr. ..... G10D 13/006 84/421
1,022,149 A * 4/1912 Maphet ..... G10D 13/026 248/166
1,604,670 A * 10/1926 Willis ..... G10D 13/026 84/422.1
1,630,701 A * 5/1927 Gladstone ..... G10D 13/026 248/688
2,433,594 A * 12/1947 Calo ..... F16M 11/14 285/261
4,177,709 A * 12/1979 Adams ..... G10D 13/065 84/402
4,252,047 A * 2/1981 Gauger ..... G10G 5/005 84/421

(Continued)

OTHER PUBLICATIONS

Black Swamp Percussion; 2012 Product Guide; "New Multi-Bass"; p. 2.

(Continued)

*Primary Examiner* — David Warren
*Assistant Examiner* — Christina Schreiber
(74) *Attorney, Agent, or Firm* — Manelli Selter PLLC;Edward J. Stemberger

(57) ABSTRACT

A horizontal support system for a percussion instrument support the percussion instrument in a horizontal position without the necessity for permanently altering the instrument structure. Preferably, the percussion instrument includes a shell having first and second open ends, a first hoop affixed to the first open end, a second hoop affixed to the second open end of said shell, and a drum head provided at one end. The support system includes a plurality of support legs. Each support leg includes a main support member; a foot member selectively positioned adjacent one end of the main support member; first and second hoop engagement members that engage the hoops of the percussion instrument. The plurality of support legs supports the percussion instrument in a horizontal position with the drum head facing up or in a tilted position.

18 Claims, 4 Drawing Sheets

(56) References Cited

U.S. PATENT DOCUMENTS 4,334,458 A * 6/1982 Grauso ..... G10D 13/023 84/411 R
4,519,289 A * 5/1985 Gauger ..... G10G 5/00 84/421
4,616,551 A * 10/1986 Bookvich ..... G10D 13/02 84/411 A
4,640,175 A * 2/1987 Hoshino ..... G10D 13/26 248/285.1
4,688,463 A * 8/1987 Kurosaki ..... G10D 13/26 84/415
4,709,613 A * 12/1987 Powers ..... G10D 13/023 84/411 A
4,903,570 A * 2/1990 Sassmannshausen G10D 13/026 84/413
4,909,125 A * 3/1990 Fece ..... G10D 13/023 84/411 A
5,309,811 A * 5/1994 Hoshino ..... G10D 13/026 248/220.21
5,329,838 A * 7/1994 Yamashita ..... G10D 13/026 84/411 R
5,337,645 A * 8/1994 Johnston ..... G10D 13/026 84/421
5,454,288 A * 10/1995 Hoshino ..... G10D 13/026 248/635
5,507,584 A * 4/1996 Sassmannshausen . F16M 11/06 248/188.6
5,544,561 A * 8/1996 Isomi ..... G10D 13/026 224/910
5,573,158 A * 11/1996 Penn ..... G10G 5/00 224/197
5,691,492 A * 11/1997 May ..... G10G 5/005 84/421
5,977,464 A * 11/1999 Bencomo, Jr. ..... G10D 13/026 84/421
5,998,717 A * 12/1999 Chen ..... G10D 13/026 84/104
6,054,645 A * 4/2000 Gauger ..... G10D 13/065 84/411 R
6,060,652 A * 5/2000 Lombardi ..... G10D 13/26 84/421
6,222,107 B1 * 4/2001 Lo ..... G10D 13/026 248/188
6,329,583 B1 * 12/2001 May ..... G10G 5/005 248/443
6,384,308 B1 * 5/2002 Hoshino ..... G10D 13/026 84/421
6,410,833 B1 * 6/2002 Brando ..... G10D 13/023 84/411 R
7,420,110 B2 * 9/2008 May ..... G10G 5/005 84/411 R
7,572,967 B2 * 8/2009 Meinl ..... G10D 13/026 248/443
7,858,859 B2 * 12/2010 Bassam ..... G10D 13/026 84/421
7,888,574 B1 * 2/2011 Acoutin ..... G10D 13/02 84/411 R
8,431,808 B2 * 4/2013 Nakata ..... G10D 13/026 84/421
8,723,008 B1 * 5/2014 Darnell ..... G10D 13/026 84/421
9,024,163 B2 * 5/2015 Sato ..... G10D 13/02 84/421
2014/0026736 A1 * 1/2014 Sato ..... G10D 13/026 84/421

OTHER PUBLICATIONS

Black Swamp Percussion; BSP MultiLegs; www.blackswamp.com/c-122-multilegs.aspx.
http://www.lpmusic.com/products/brazilian-percussion/brazilian-aluminum-surdo-with-legs/.
RMV Brazilian Percussion; RMV 18" and 20" Wood Surdos with Pre-installed legs.

* cited by examiner

SUPPORT SYSTEM AND METHOD FOR A PERCUSSION INSTRUMENT

BACKGROUND OF THE INVENTION

1. Field of the Invention

The present invention relates to a support system for quickly and efficiently mounting a percussion instrument in a horizontal position.

2. Description of Related Art

Conventionally, a support system for a bass drum requires a marching harness when used in a marching band (see for example, prior art FIG. 1) or support holes on the drum shell when placed on a floor when used in a conventional drum kit (see for example prior art FIG. 2). The drilling of support holes on the drum shell requires a sophisticated production process, may cause harm to the drum itself and may affect the sound that emanates from the drum. Further, the support holes are located at specific positions on the drum which may hamper the user's ability to locate other instruments onto or adjacent the bass drum.

Additionally, when a support system is mounted directly to the drum shell, it will affect the drum resonance and the drumming sound may become dull and inactive. When the drum is suspended in a conventional manner, such as when used for marching, the support fixtures mounted directly to the drum shell may make the drum heavy and impractical for marching bands.

The need exists for a bass drum or other drums typically played in a standing position to be supported by a system that allows individuals, school marching bands, etc. to use existing bass drums and allow them to be played the vertically or horizontally in a convenient and effective manner.

To overcome the shortcomings of the prior art, the present invention provides a mounting and support system that is able to mount a variety of percussion instruments in a horizontal position without hampering a user's ability to support the same drum in either a vertical or other position at other times.

SUMMARY OF THE INVENTION

An objective of the present invention is to provide a support system for a percussion instrument, comprising a series of support legs including a main support member having a foot member selectively positioned adjacent one end of the main support member. The foot member is formed to engage a substrate surface, such as a floor or stage. The support system further includes a first hoop engagement member formed to engage a first percussion instrument hoop proximate one end of the main support member and a second hoop engagement member formed to engage a second percussion instrument hoop. The first and second hoop engagement members are moveable to and from one another to accommodate different sized percussion instruments.

The support legs provide a support system that is design to support a bass drum or other percussion instrument in a horizontal position without destroying the ability to mount the percussion instrument by other means.

In one embodiment, the support system includes the combination of a percussion instrument and instrument support system, whereby the percussion instrument comprises a shell having first and second open ends, a first hoop affixed to a first open end of the shell, a second hoop affixed to a second open end of the shell, and a drum head provided at one or both ends. The support system includes a plurality of support legs. Each support leg comprises a main support member. A foot member is selectively positioned adjacent one end of the main support member. A first hoop engagement member is formed to engage the first hoop proximate the one end of the main support member. A second hoop engagement member is formed to engage the second hoop. The plurality of support legs support the percussion instrument in a horizontal position with the drum head facing upwardly in a horizontal or at angled positions.

The first and second hoop engagement members are preferably formed with a hook shape, but may take other shapes depending upon the type of percussion instrument being supported.

In one embodiment, the main support member comprises first and second tubes running side by side. In this embodiment, the foot member comprises a telescopic inner tube passing into the first tube of the main support member, and the second engagement member comprises a telescopic inner tube passing into the second tube of the main support member.

The support system of this invention may be used to support a variety of percussion instruments such as a bass drum, a kettle drum, a solid drum, and/or a sling drum. The invention should not be limited to these specific types of percussion instruments.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
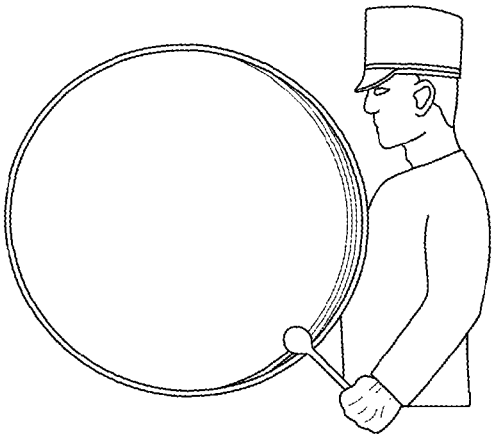
Fig. 1 Prior Art
FIG. 1 is a side view of a conventional bass drum supported by a harness worn by a member of a marching band.
Figure 2:
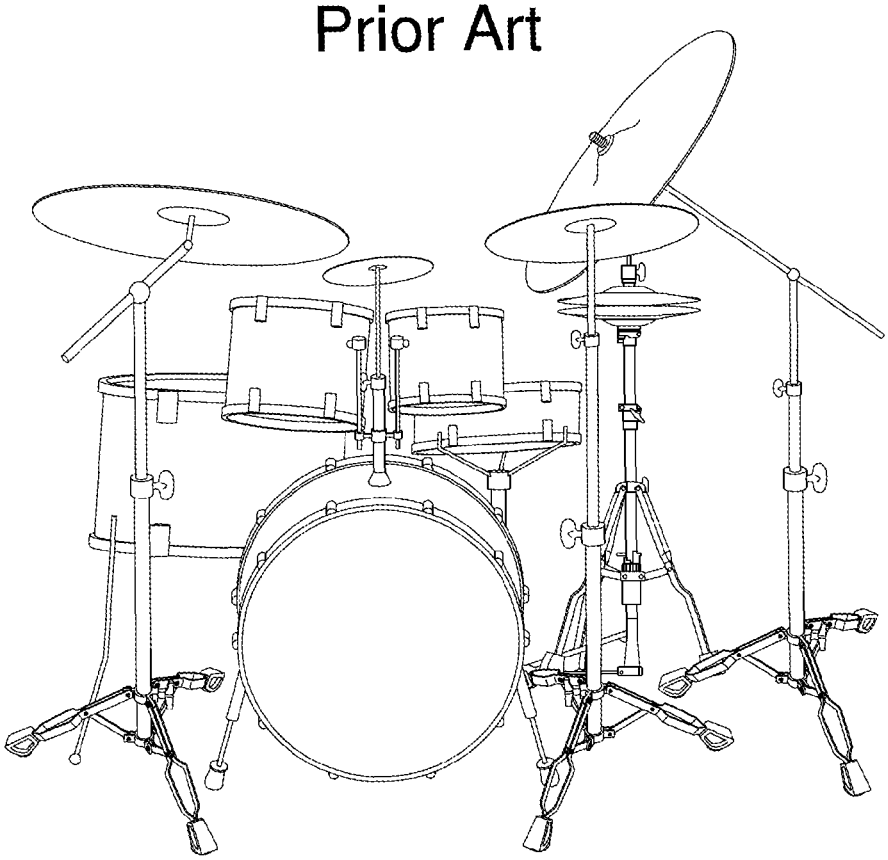
Fig. 2 Prior Art
FIG. 2 is a perspective view of a conventional drum kit having a bass drum.
Figure 3:
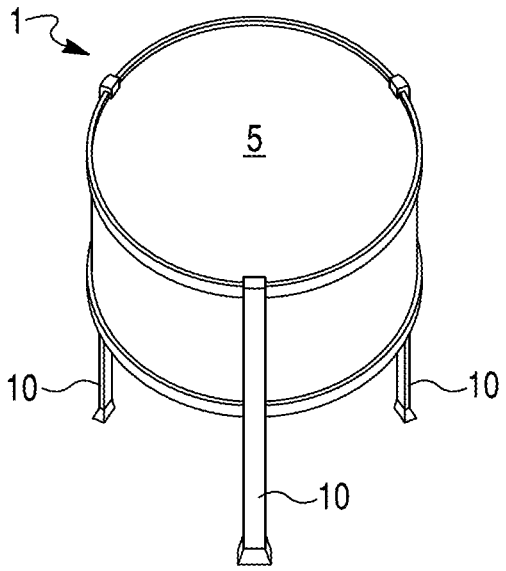
FIG. 3 is a side view of a bass drum shown in a horizontal position employing the support legs of the mounting assembly in accordance with the present invention.
Figure 4:
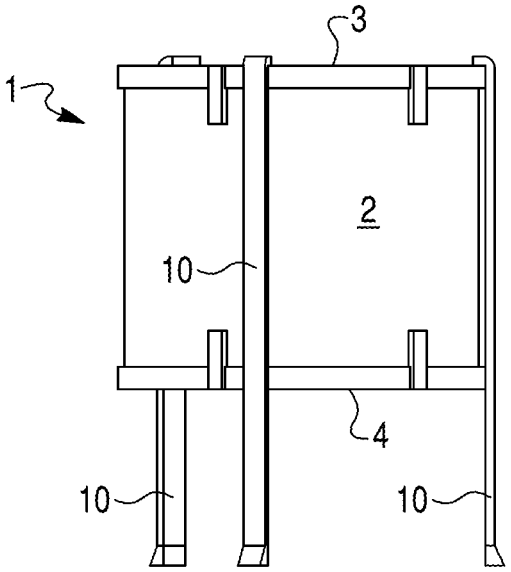
FIG. 4 is a perspective view of a bass drum employing the support legs of the mounting assembly in accordance with the present shown in an angled position.

With reference to FIGS. 3-4, a mounting assembly with a plurality of support legs 10 for a percussion instrument 1 in accordance with the present invention comprises a bass drum including a drum shell 2, a top drum hoop 3 and a bottom hoop 4. Conventionally, a drumhead 5 is secured in place between the top drum hoop 3 and the drum shell 2 by tension placed on the top drum hoop 3 in a conventional manner. As best shown in FIGS. 3 and 4, a plurality of support legs 10 are secured to the percussion instrument 1 in different positions around the perimeter of the usually circular instrument 1. As will be described in detail below, the support legs 10 are selectively positioned around the instrument 1 by securing the support legs 10 to top and bottom hoops 3, 4 of the percussion instrument 1.

Figure 5:
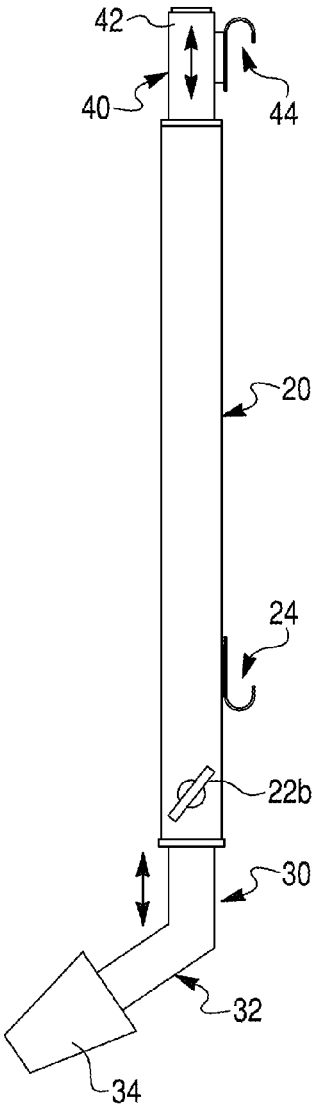
FIG. 5 is a side view of a first embodiment of a support leg in accordance with the present invention.
Figure 6:
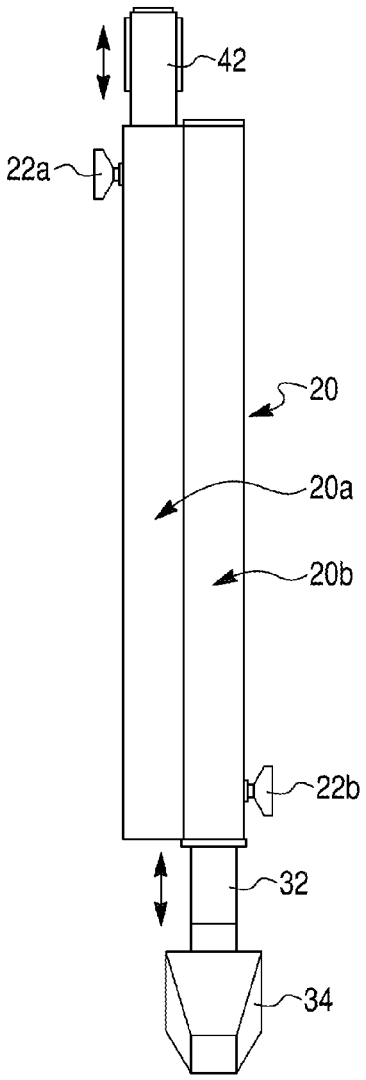
FIG. 6 is a front view of the support shown in FIG. 5.

With reference to FIGS. 5 and 6, the structure of one embodiment of a support leg 10 according with the invention will be described. It will be understood that the other support legs are correspondingly shaped and formed. Also, while three support legs 10 are illustrated, a greater or fewer number may be used in carrying out the invention. The support leg 10 shown in FIG. 5 includes a main support member 20 and a foot member 30 which may be telescoped into main support member 20 in order to adjust the length of support leg 10. The telescopic foot member 30 includes a telescopic tube 32 which supports a rubber foot 34. The telescopic tube 32 is preferably angled to provide a wider stance for improved stability. In the embodiment of FIGS. 5-6, the support leg 10 further includes an engagement member 40 that may be telescoped into and out of main support member 20. The telescopic engagement member 40 includes a telescopic tube 42 and an upper engagement hook 44. Similarly, the main support member 20 is provided with a lower engagement hook 24 fixed to the main support member by suitable means, such as welding or other fastening means known to those of skill in the art and depending on the materials that form the main support member 20. The upper and lower engagement hooks 44, 24 are designed and shaped to accommodate conventional hoops of different percussion instrument as described herein.

As best shown in FIG. 6, the main support member 20 is preferably but not necessarily designed to include two aligned tubes 20*a*, 20*b* to respectively accommodate the telescopic tube 42 of the engagement member 40 and the telescopic tube 32 of the telescopic foot member 30. The telescopic tubes 32, 42 are provided to allow instruments of different depths and sizes to be carried by the support system of the present invention. The main support member 20 is also provided with fasteners such as wing nuts 22*a*, 22*b* to secure the telescopic tubes 32, 42 with respect to the main support member 20 after the tubes 32, 42 are placed in a desired position.

Mounted on the tube 20*a* of the main support member 20 is a lower engagement hook 24 (see FIG. 5) which is provided to engage the lower edge of the lower drum hoop 4 or the lower edge of the drum shell 2. The upper and lower engagement hooks 44, 24 may be formed of any suitable material and of any suitable shape. In one embodiment, the hooks 24, 44 may be rubberized or rubber coated to protect to hoops 3, 4 from damage. Additionally, an insert or shim may be used to alter the radius of the hooks 24, 44 to accommodate instruments with narrower hoops 3, 4.

The two aligned tubes 20*a*, 20*b* can be made of any suitable material and shape and may be secured together and/or formed by different means known to those of skill in the art. An important consideration is the ability to adjust the leg height via the telescopic foot member 30 and to adjust the height of the top hook 44 on the telescopic engagement member 40.

In accordance with this invention, a plurality (preferably three) of support legs 20 are disposed about the circumference of a bass drum 1 or other percussion instrument in uniformly spaced relation. The lower telescopic foot members 30 permit the adjustment of height and tilt of the percussion instrument 1 as shown in FIGS. 3 and 4. The upper telescopic engagement member 40 assists adjustment in accordance with the width of the drum shell 2.

Figure 7:
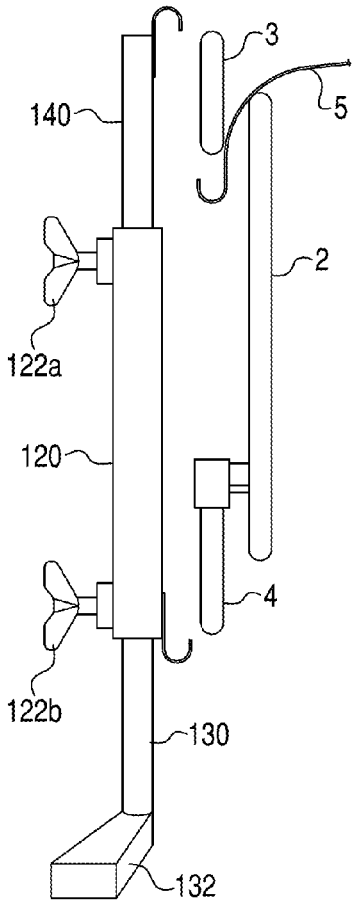
FIG. 7 is a side view of a second embodiment of the support leg of the mounting assembly in accordance with the present invention.

A second embodiment of the support system is shown in FIG. 7. The second embodiment provides a main support member 120 formed as a single tube that houses both the telescopic foot member 130 and the upper telescopic engagement member 140. As with the first embodiment, fasteners 122*a*, 122*b* are provided on the main support member 120 to selectively lock the telescopic members 130, 140 relative to the main support member 120. The second embodiment also illustrates a straight telescopic foot member 130 with a rubberized foot or other suitable floor engagement foot member 132.

Figure 8:
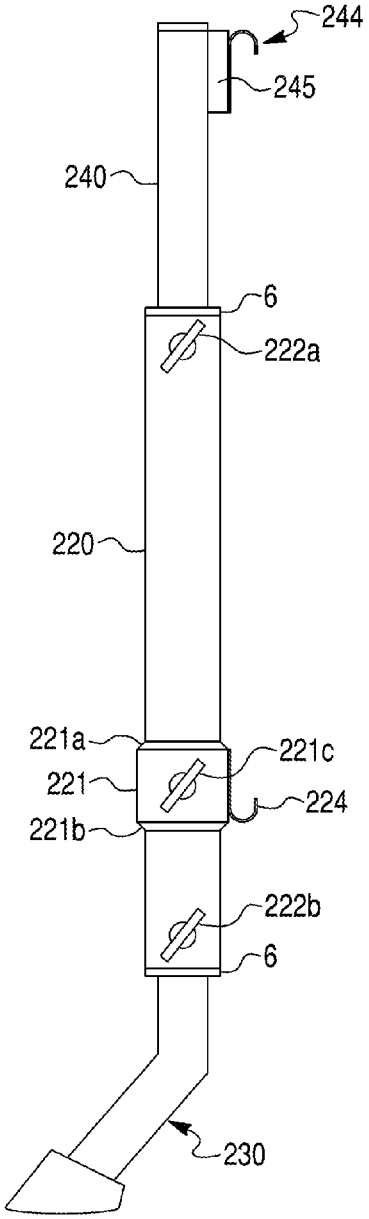
FIG. 8 is a side view of a third embodiment of the support leg of the mounting assembly in accordance with the present invention.

A third embodiment of the support system is shown in FIG. 8. As with the second embodiment, fasteners 222*a*, 222*b* are provided on the main support member 220 to selectively lock the telescopic members 230, 240 relative to the main support member 220. With the third embodiment, the lower engagement hook 224 (corresponding to element 24 in FIG. 5) is slidingly disposed on the main support element 220 via a lockable collar 221 provided with bushings 221*a*, 221*b*. The lockable collar 221 and thus the lower engagement hook 224 is selectively locked with respect to the main support element via a wing nut 221*c* or other suitable fastener. For the third embodiment shown in FIG. 8 and the other embodiments described herein, a suitable bushing 6 may be provided on the main support member openings that receive the upper and lower telescoping tubes 30, 40, 130, 140, 230, 240. In the third embodiment of FIG. 8 having the slidable locking collar 221, a standoff shim 245 may be provided between the upper hook 244 and the upper telescopic tube 240 to align the upper and lower hooks 244, 224.

The foregoing embodiments are not intended to provide a limiting scope to this invention, For example, the invention has been shown and described with reference to a bass drum; however, as stated above the present invention may be equally used with respect to Cajon (square) drum whereby the upper and lower hooks could engage the drum at cut or score locations formed into the drum. Likewise, the invention may be applied to drums having a larger top hoop that the lower section. In this case, a cradle may be formed and received on the lower hooks to support the bottom of the drum while the upped hooks engage the drum in the manner described above with respect to embodiments 1-3.

The support system according to the present invention provides a new and useful support for a bass drum and other drums typically played in a standing position to allow individuals, school, etc. to play existing percussion instruments either vertically or horizontally in a convenient and effective manner.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

The invention claimed is:

1. A support system for a percussion instrument, comprising:

a main support member;

a foot member selectively positioned adjacent one end of said main support member, said foot member being formed to engage a substrate surface;

a first hoop engagement member formed to engage a first percussion instrument hoop proximate said one end of said main support member; and a second hoop engagement member formed to engage a second percussion instrument hoop, wherein said first and second hoop engagement members are moveable relative to each other, wherein said foot member is disposed in telescopic relation with said main support member so as to be slidable with respect to said main support member, and wherein said second hoop engagement member is fixed onto a telescopic inner tube disposed within a portion of said main support member.

2. The support system according to claim 1, wherein said first hoop engagement member is formed with a hook shape.

3. The support system according to claim 1, wherein said second hoop engagement member is formed with a hook shape.

4. The support system according to claim 1, wherein said foot member telescopes within said main support member.

5. The support system according to claim 1, wherein at least one of said first and second hoop engagement members is slidingly disposed with respect to said main support member.

6. The support system according to claim 1, wherein both said first and second hoop engagement members are slidingly disposed with respect to said main support member in an independent manner.

7. The support system according to claim 1, wherein said main support member comprises first and second tubes disposed side by side so that the first and second tubes do not share a common longitudinal axis.

8. The support system according to claim 7, wherein said foot member comprises a telescopic inner tube passing into said first tube of said main support member.

9. The support system according to claim 7, wherein said second engagement member comprises a telescopic inner tube passing into said second tube of said main support member.

10. A combination percussion instrument and instrument support system, comprising:

a percussion instrument comprising a shell having first and second open ends, a first hoop affixed to said first open end of said shell, a second hoop affixed to said second open end of said shell, and a drum head provided at said first end;

a plurality of support legs, each support leg comprising:

a main support member;

a foot member selectively positioned adjacent one end of said main support member, said foot member being formed to engage a substrate surface;

a first hoop engagement member formed to engage said first hoop proximate said one end of said main support member;

a second hoop engagement member formed to engage said second hoop, wherein said plurality of support legs supports said percussion instrument in a horizontal position with said drum head facing up, substantially parallel with the substrate surface.

11. The combination according to claim 10, wherein said percussion instruments is chosen from the group consisting of a bass drum, a kettle drum, a solid drum, and a sling drum.

12. The combination according to claim 10, wherein said first and second hoop engagement members are moveable to and from one another to accommodate different sizes for the percussion instrument.

13. The combination according to claim 10, wherein at least one of said first and second hoop engagement members is slidingly disposed with respect to said main support member.

14. The combination according to claim 10, wherein both said first and second hoop engagement members are slidingly disposed with respect to said main support member in an independent manner.

15. The combination according to claim 10, wherein said second hoop engagement member is fixed onto a telescopic inner tube disposed within a portion of said main support member.

16. The combination according to claim 10, wherein said main support member comprises first and second tubes running side by side, wherein said foot member comprises a telescopic inner tube passing into said first tube of said main support member, and wherein said second engagement member comprises a telescopic inner tube passing into said second tube of said main support member.

17. The combination according to claim 10, wherein said foot member is disposed in telescopic relation with said main support member so as to be slidable with respect to said main support member.

18. The combination according to claim 17, wherein said foot member telescopes within said main support member.

* * * * *